United States Patent [19]

Kralowetz

[11] 3,992,917

[45] Nov. 23, 1976

[54] FORGING MACHINE

[76] Inventor: Bruno Kralowetz, St. Ulrich 142, Steyr, Austria

[22] Filed: Sept. 18, 1975

[21] Appl. No.: 614,505

[30] Foreign Application Priority Data

Oct. 9, 1974 Austria ..... 8098/74

[52] U.S. Cl. ..... 72/407; 10/12 R; 72/447; 72/462; 72/472

[51] Int. Cl.[2] ..... B21J 13/02

[58] Field of Search ..... 72/407, 447, 413, 472, 72/404, 455, 446, 462; 10/12 T, 12 R

[56] References Cited

UNITED STATES PATENTS

| | | | |
|---|---|---|---|
| 667,187 | 5/1901 | Carstens | 10/12 T |
| 3,472,058 | 10/1969 | Hautau | 72/407 |
| 3,477,075 | 11/1969 | Putetti | 10/12 R |
| 3,916,668 | 11/1975 | Schmoll | 72/447 |

*Primary Examiner*—C.W. Lanham
*Assistant Examiner*—Gene P. Crosby
*Attorney, Agent, or Firm*—Kurt Kelman

[57] ABSTRACT

Two tool carriers are mounted in a machine housing and guided on an axis and adapted to act oppositely on each other. The tool carriers have confronting ends. Each of two forging tools has a plurality of working profiles and is mounted on one of said tool carriers and shiftable thereon to a plurality of working positions associated with respective ones of said working profiles. Each working profile is arranged to be centered on said axis when the tool provided with said working profile is in the working position associated with said working profile. Locking means are provided, which are adapted to lock each of said tools on the associated tool carrier in each of said working positions.

12 Claims, 14 Drawing Figures

FORGING MACHINE

This invention relates to a forging machine comprising two tool carriers, which are guided in a machine housing and at their ends receive the forging tools and act oppositely on each other.

The range of application of such forging machines could be extended and the setting-up and dead times of the machine could be shortened if tools could be used which have two or more working profiles so that forging operations can be carried out without an exchange of tools. Whereas such tools having two working profiles have already been used in drop forging machines, these tools are firmly screw-connected to the tool carrier and the die cavity and workpiece must be moved into the range of the desired working profile. For economical reasons, these measures cannot be adopted with other forging machines because in that case the manipulators required for the forging work would be much too expensive. Besides, the difficulty would arise that the forging force is not centered with respect to the tool carrier so that considerable bending moments would be set up during the forging operation and would have to be taken up by the swaging machine.

It is an object of the invention to provide a forging machine which is of the kind described first hereinbefore and which enables the use of tools having two or more working profiles whereas the forging forces acting during the forging operation are centered on the axis of the tool carrier and expensive manipulators are not required for the forging work.

This object is accomplished according to the invention essentially in that the tools comprising at least two working profiles are shiftably mounted on the tool carrier and are adapted to be locked to the tool carrier in a number of working positions, each of which is associated with one of the working profiles, which is the associated working position is centered on the axis of the tool carrier. For instance, when it is desired to forge with a given working profile, the tool is shifted to the working position which is associated with that working profile and is locked in that working position. When the tool is in a given working position, the axis of the tool carrier is in the plane of symmetry of the associated working profile, which plane of symmetry extends through the longitudinal axis of the workpiece. For this reason the resultant of the forging forces is centered with respect to the tool carrier. To enable the use of the several working profiles for forging the workpieces, the latter need not be lifted or lowered or laterally displaced so that simple manipulators are sufficient for the forging work. The forging machine according to the invention can perform cylindrical forging on workpieces differing widely in diameter and can forge workpieces which are rectangular in cross-section, with the same tools and without an occurrence of adverse conditions, difficulties or a high expenditure.

In a further embodiment of the invention, the tools are firmly mounted on a baseplate and the latter is guided in a rail or the like provided on the tool carrier and is adapted to be spring-forced against said rail or the like in the working positions. For this reason the baseplate of the tool can easily be shifted along the rail of the tool carrier to the various working positions, in which the baseplate is firmly urged against the rails or the like by springs. When the baseplate is relieved of the spring force, the tools can easily be moved to any selected working position. In each working position, the spring force ensures a firm contact between the rail and the baseplate so that the tools cannot lift from the tool carrier during the forging operation and chattering or the like is reliably prevented.

When two working profiles are provided on each tool, the rail or the like of the tool carrier forms preferably two end stops, which are engaged by the baseplate of the tool in respective working positions, and a transversely extending, central rotary wedge locks the baseplate in these working positions. The tools can then be moved exactly to the desired working position in that they are shifted to the respective stop. The rotary wedge is then turned to clamp the baseplate between the stop and the rotary wedge so that the tool is well fixed in its working position.

If each tool has more than two working profiles, two rotary wedges are provided in accordance with the invention, which act in opposite senses of rotation and serve to lock the baseplate of the tool relative to the rail of the tool carrier. Because more than two working positions are provided in this case, the tool can no longer be fixed in cooperation with stops on the tool carrier. In that case a second rotary wedge performs the function of the stops so that the tool can be sufficiently clamped on the tool carrier in any desired working position by means of these two rotary wedges.

To enable a rotating of the rotary wedges, it is a feature of the invention that pivoted levers are provided, which act on the rotary wedges and are movable by hydraulic drive means.

According to a particularly desirable embodiment of the invention, the hydraulic drive means for moving the pivoted lever which is connected to the central rotary wedge comprise in known manner two pistons, which are rigidly interconnected by a common piston rod and are enclosed by respective cylinders, one of which is pivoted to the machine housing at that end of the cylinder which is remote from the piston rod, whereas the other cylinder is longitudinally guided on the machine housing and carries a recessed coupling member for engaging the pivoted lever. When only one central rotary wedge is used which coacts with one or the other of the end stops of the rail of the tool carrier, this rotary wedge must be pivotally movable to three angular positions, namely, to a release position and in two locking positions associated with respective ones of the end stops. To ensure that these three angular movements are always exactly performed, the hydraulic drive means for the pivoted arm connected to the rotary wedge can perform two exactly defined movements, for one of which the cylinder carrying the recessed coupling member is moved together with the double piston, whereas for the second movement said cylinder is moved relative to the double piston. In this case the hydraulic drive means according to the invention can always be used reliably to move the rotary wedge to its three rotary positions.

In another embodiment of the invention, each rotary wedge is formed with cams or the like, each of which is disposed adjacent to an associated journal with which the rotary wedge is mounted in the rail of the tool carrier, each of said cams or the like engages a ram in the locking position of the rotary wedge, and springs are provided, each of which is stressed between one of said rams and the baseplate of the tool. When the tools are locked by the rotary wedges, the baseplate is automatically forced against the tool carrier, particularly the rail thereof, by the spring provided between the ram and the baseplate of the tool. In the release position of the rotary wedge the ram is no longer supported by the cam or the rotary wedge and the spring becomes ineffective because the ram is now forced against the baseplate itself. As soon as the tool is locked, the cam lifts the ram and the spring bears by means of the ram on the rotary wedge and urges the baseplate with the desired force against the rail of the tool carrier.

It will be particularly desirable if the rail of the tool carrier extends vertically and the tool is adapted to be shifted by a backing roller or the like, which is engageable with a lower engaging surface of the baseplate of the tool and is rotatably mounted on one arm of a bell-crank lever, which adjacent to its apex is pivoted to the machine housing whereas its other arm is acted upon by hydraulic drive means. Owing to the provision of the vertical rail, gravitational force may be utilized to lower the tools. The backing roller serves only to brake the descent and, of course, to the lift the tools. An upward and downward pivotal movement is imparted to the backing roller by the bell-crank lever and the hydraulic drive means.

Where tools having two working profiles each are provided, the hydraulic drive means acting on the bell-crank lever comprise in known manner a double cylinder having two cylinder chambers arranged one behind the other, a piston having a piston rod pivoted to the bell-crank lever is disposed in one cylinder chamber, and a piston having a piston rod pivoted to the machine housing is disposed in the other cylinder chamber. This double cylinder arrangement enables an exact control of the pivoted movement of the bellcrank lever and of the ascent and descent of the backing roller. The tool can be moved to its two working positions and the backing roller can be lifted from the engaging surface of the baseplate as soon as the workpiece is locked in a desired working position. As a result, the backing roller is disengaged from the baseplate during the forging motion proper.

Where tools having three working profiles are used, the hydraulic drive means acting on the bell-crank lever comprises a cylinder having three cylinder chambers arranged one behind the other, a piston having a piston rod pivoted to the machine housing is disposed in the outer cylinder chamber, a piston having a free piston rod extending into the other outer cylinder chamber is disposed in the intermediate cylinder chamber, and a piston having a piston rod pivoted to the bell-crank lever is disposed in the last-mentioned outer cylinder chamber. These hydraulic drive means comprise virtually three series-connected parts and are required for a movement of the tools to their three possible working positions. In this case it is also essential exactly to perform the required strokes. This is ensured by the selection of the required longitudinal dimensions of the cylinder chambers and of the pistons and piston rods.

The subject matter of the invention is shown strictly diagrammatically on the accompanying drawings, in which.

Figure 1:
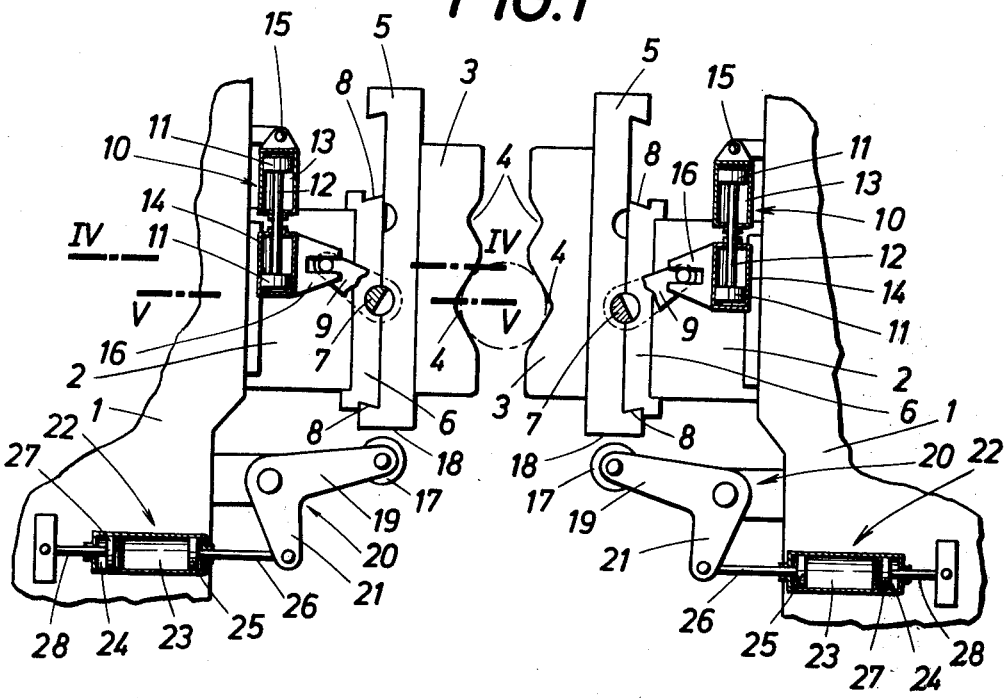
FIGS. 1 to 3 are side elevations, partly in section, showing an illustrative embodiment of the invention with the tools in different positions.
Figure 2:
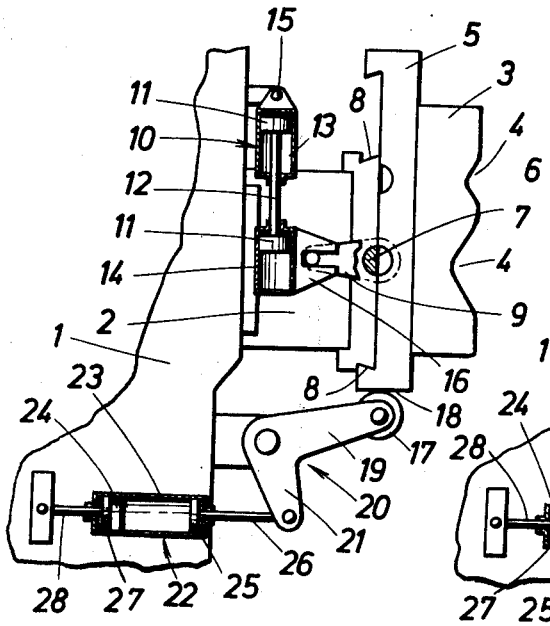
Figure 3:
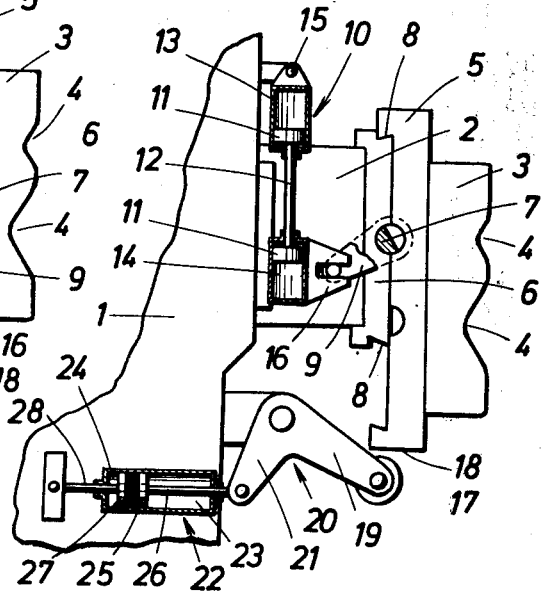
Figure 4:
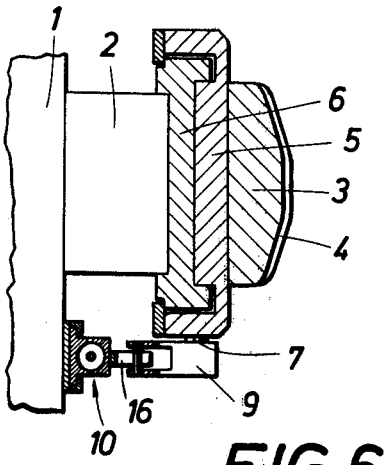
FIG. 4 is a sectional view taken on line IV—IV in FIG. 1.
Figure 5:
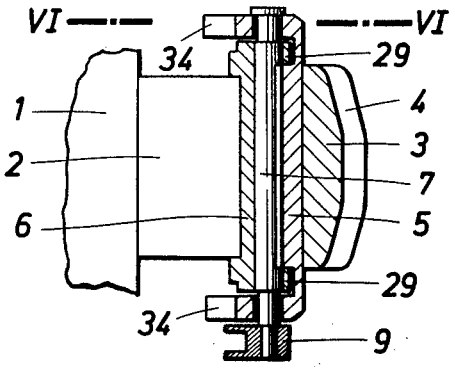
FIG. 5 is a sectional view taken on line V—V in FIG. 1.
Figure 6:
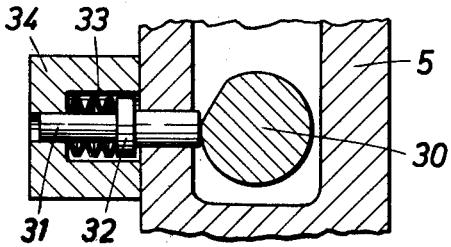
FIGS. 6–8 are enlarged sectional views taken on line VI—VI in FIG. 5 and showing the rotary wedge in different angular positions.
Figure 7:
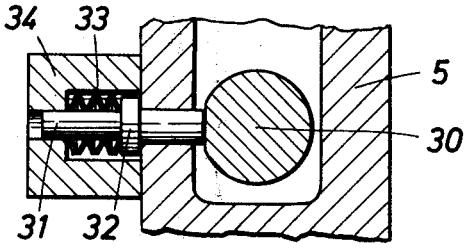
Figure 8:
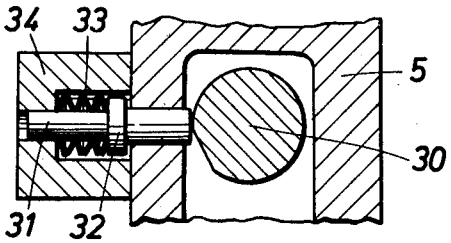
Figure 9:
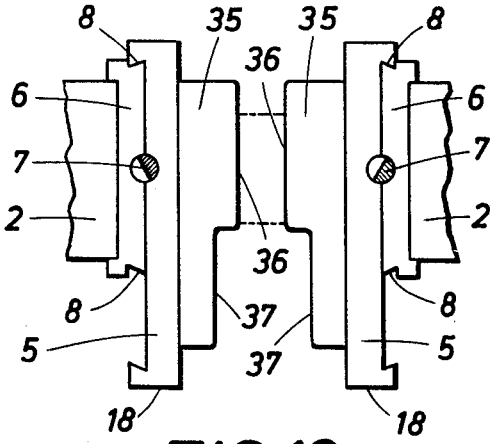
FIGS. 9 and 10 show the use of a tool for forging workpieces to a rectangular shape.
Figure 10:
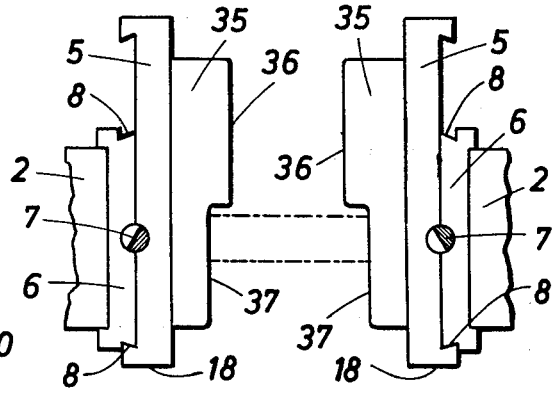
Figure 11:
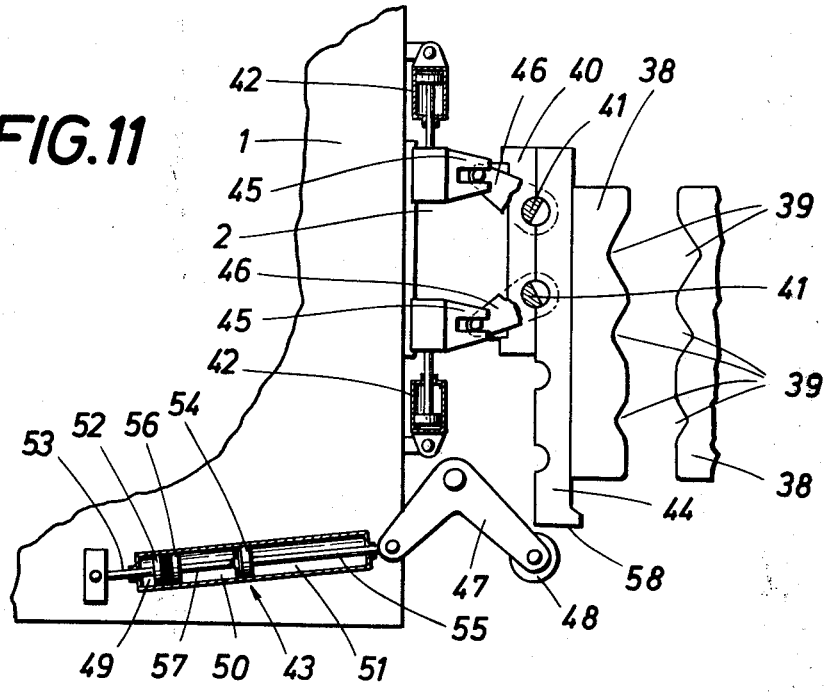
FIGS. 11–14 are side elevations, partly in section, showing another illustrative embodiment of the invention with the tools in different positions.
Figure 12:
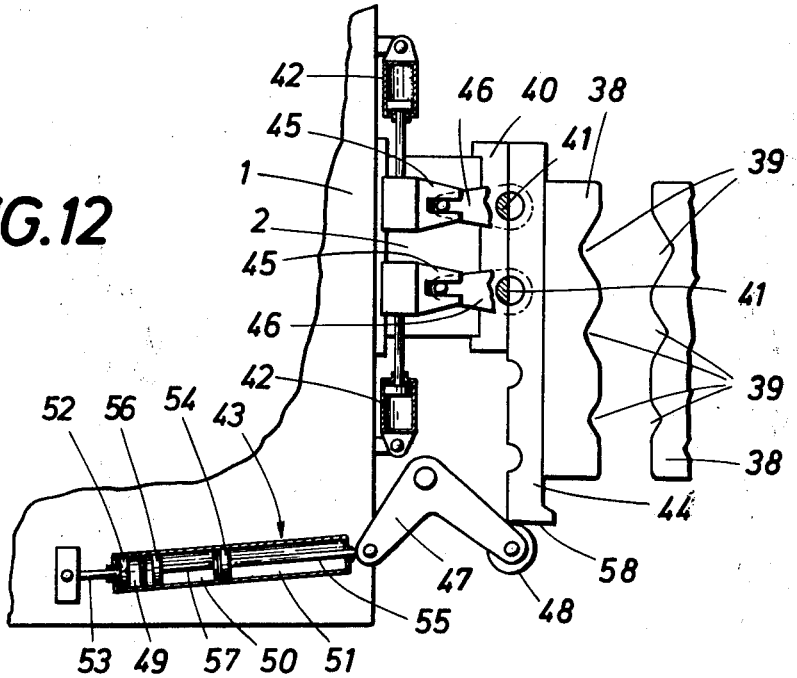
Figure 13:
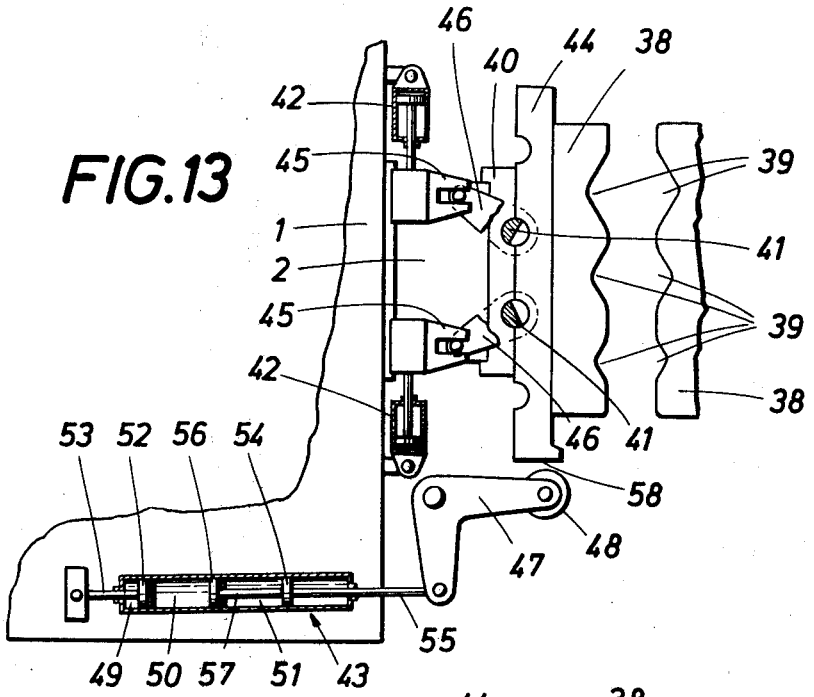
Figure 14:
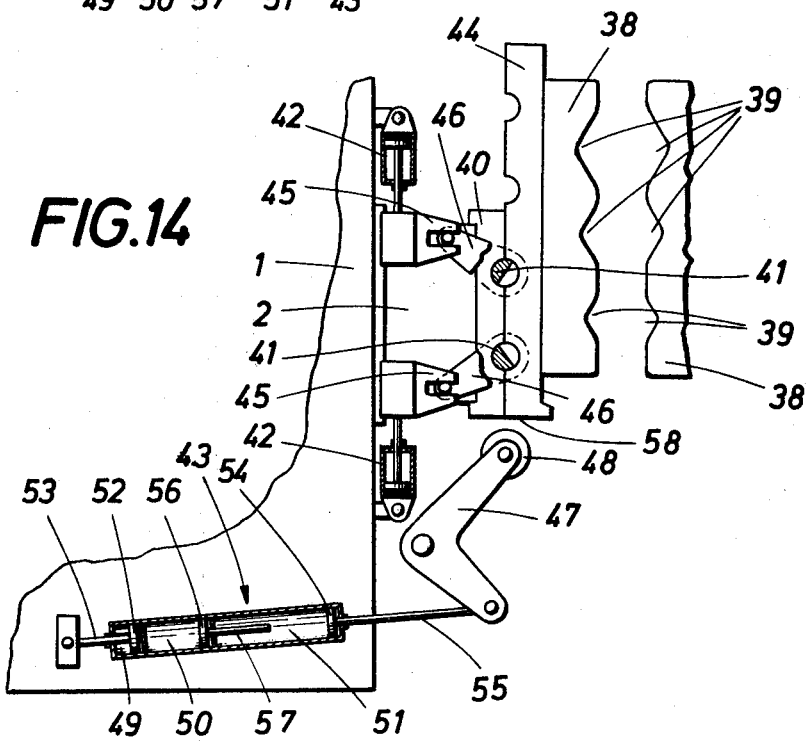

Two tool carriers 2 acting oppositely on each other are horizontally guided in a machine housing 1 and carry forging tools 3 at their ends. As is shown in Figs. 1 to 3, each forging tool 3 comprises two working profiles 4 and is firmly mounted on an associated baseplate 5. The baseplate 5 is vertically slidably guided on a rail 6 of the tool carrier 2 and is adapted to be locked by a central transverse rotary wedge 7 in two working positions, each of which is associated with one working profile 4. The rail 6 of the tool carrier forms two end stops 8, which are arranged to engage the baseplate exactly in respective working positions of the tool 3. By means of hydraulic drive means 10 acting on a pivoted lever 9, the rotary wedge 7 can be moved to three functional positions. These include a release position, shown in FIG. 2, and two locking positions, which are shown in FIGS. 1 and 3 and in which the rotary wedge cooperates with respective end stops 8. To ensure that the rotary wedge 7 will be moved exactly to these three positions by the operation of the pivoted level 9, the hydraulic drive means 10 comprise two pistons 11, which are rigidly interconnected by a common piston rod 12. Each piston 11 is enclosed by an associated cylinder 13 or 14. One cylinder 13 has an end 15 which is remote from the piston rod and pivoted to the machine housing 1. The other cylinder 14 carries a recessed coupling member 16 for engaging the pivoted lever 9. Various relative movements between the pistons 11 and the cylinders 13, 14 can be effected to rotate the pivoted lever 9 and the rotary wedge 7 to the desired extent. The tools can be shifted along the rail of the tool carrier by a backing roller 17, which is engageable with a lower engaging surface 18 of the baseplate of the tool. The backing roller 17 is mounted on one arm 19 of a bell-crank lever 20, which is pivoted to the machine housing and has another arm 21, which is acted upon by hydraulic drive means 22. The latter comprises a double cylinder having two cylinder chambers 23, 24, which are arranged one behind the other and each of which contains a piston 25 or 27. The piston 25 is provided with a piston rod 26, which is pivoted to the arm 21 of the bell-crank lever. The other piston 27 is provided with a piston rod 28, which is pivoted to the machine housing 1. By means of these hydraulic drive means, the backing roller 17 can be engaged with the engaging surface 18 of the baseplate 5. When the rotary wedge is in its release position, the baseplate and the tool 3 can then be lifted or lowered to the desired working position. The angular movements which must be imparted for this purpose to the bell-crank level 20 are determined by the longitudinal dimensions of the cylinder chambers, the pistons and the piston rods. The tool 3 having two working profiles 4 may thus be moved to its two working positions even while the machine is running, and in each working position the associated working profile is centered on the axis of the tool carrier. The stops 8 and the rotary wedge 7 ensures together with the rail 6 of the tool carrier that the tools will be reliably and definitely fixed in the respective working position. To ensure that any backlash between the baseplate and the rail of the tool carrier will be compensated even during the forging operation, the baseplate is forced by springs against the rail 6 of the tool carrier in the working positions of the tool 3. For this purpose, each rotary wedge 7 is provided with two cams 30, each of which is disposed adjacent to one of the journals 29 with which the rotary wedge 7 is mounted in the rail 6 of the tool carrier, and two rams 31 are provided, which in the locking positions of the rotary wedge bear on respective ones of the cams 30 and by means of associated collars 32 are loaded by respective springs 33, which are mounted in housings 34 connected to the baseplate 5. Because the ram bears on the cam 30 and the rotary wedge 7, the spring 33 forces by means of the housing 34 the baseplate 5 against the rail 6 of the tool carrier. As soon as the rotary wedge 7 is in release position, the ram 31 is no longer supported by the cam 30 (FIG. 7) and the spring 33 becomes ineffective because the collar 32 of the ram 31 now also engages the baseplate. When the rotary wedge is in one of its two locking positions, shown in FIGS. 6 and 8, the cam 30 lifts the collar 32 of the ram 31 and the latter from the baseplate and the spring can now urge the baseplate toward the rail of the tool carrier so that the tool and the tool carrier always remain firmly forced against each other in the working position and there can be no chattering or the like. For a change of the working profile, the rotary wedge must be unlocked so that the spring does no longer act on the baseplate, the contact between the baseplate and the rail is loosened and the baseplate is displaced along the rail.

Instead of the tool 3 which has two V-shaped working profiles 4 for a cylindrical forging of workpieces to two different diameters, a tool 35 may be used, e.g., which serves to forge a workpiece to a rectangular shape. This workpiece comprises two working profiles, namely, a rib surface 36 for forging and stretching on the long side of the rectangle and a straightening face 37 for forging and straightening the narrow side of the rectangle. This tool is also mounted and held, displaced and locked in the manner described with reference to FIGS. 1–8 for the tool 3 for cylindrical forging.

FIGS. 11–14 show how a workpiece 38 having three working profiles 39 can be held, displaced, and locked. This embodiment is based on the same principle which has been adopted for the tools having two working profiles, with the exception that two rotary wedges 41 are provided for locking the tools 38 on the rail 40 of the tool carrier. Besides, the hydraulic drive means 42, 43 for adjusting the rotary wedge and for shifting the tools 38 are different to meet the new requirements. The tool 38 has three possible working positions and the rail 40 of the tool carrier has no end stops. For this reason two rotary wedges 41 are provided, which act oppositely against each other and serve to clamp the baseplate 44 of the workpiece against the rail 40 of the tool carrier. For this purpose it is sufficient to move each rotary wedge to two rotary positions, namely, a release position and a locking position. Hydraulic drive means 42 are associated with each rotary wedge 41 and consist of a cylinder-piston unit and a recessed coupling member 45 for moving the pivoted arm 46 of the rotary wedge to its two angular positions. The two hydraulic drive means 42 for the rotary wedges 41 act in mutually opposite directions so that the rotary wedges 41 are always rotated in mutually opposite directions.

To enable a movement of the workpiece 38 to its two working positions, the hydraulic drive means 43 for imparting suitable angular movements to the bell-crank levers 47 by means of the backing roller 48 comprise a cylinder having three cylinder chambers 49, 50, 51, which are connected one behind the other. Two pistons 52, 54 are respectively disposed in the two outer cylinder chambers 49, 51. The piston 52 has a piston rod 53, which is pivoted to the machine housing 1. The piston 54 has a piston rod 55, which is pivoted to the bell-crank lever 47. A free piston 56 is disposed in the intermediate cylinder chamber 50 and is provided with a piston rod 57, which is adapted to enter the cylinder chamber 51. These series-connected piston drives can be used for imparting to the backing roller 48 exactly the lifting and lowering movements required to shift the tool. This is apparent from FIGS. 11-14. For this reason the backing roller 48 can be engaged with and lifted from the respective engaging surface 58 in each working position of the tool and the tool 38 and particularly its baseplate 44 can be moved to the three working positions.

What is claimed is:

1. A forging machine which comprises a machine housing, two tool carriers mounted in said machine housing and guided on an axis and adapted to act oppositely on each other, said tool carriers having confronting ends, a guide carried by each of the tool carriers, two forging tools, each of which has a plurality of working profiles and is mounted on one of said tool carriers and shiftable thereon to a plurality of working positions associated with respective ones of said working profiles, each working profile being arranged to be centered on said axis when the tool provided with said working profile is in the working position associated with said working profile, each of the tools comprising a base plate guided on said guide, and locking means adapted to lock each of said tools on the associated tool carrier in each of said working positions, said locking means comprising spring means adapted to force said baseplate against said guide in each of said working positions of said tool.

2. A forging machine as set forth in claim 1, in which each of said guides is a rail.

3. A forging machine as set forth in claim 2, in which said rail is vertical, each of said baseplates has a lower engaging surface, and means for shifting each of said tools along said guide are provided and comprise a bell-crank lever, which has first and second arms and an apex portion connecting said arms and pivoted to said machine housing, backing means mounted on said first arm, and engageable with said engaging surface, and hydraulic drive means operatively connected to said second arm.

4. A forging machine as set forth in claim 3, in which said backing means comprise a backing roller.

5. A forging machine as set forth in claim 3, in which each of said tools have two working profiles and said hydraulic drive means comprise a double cylinder defining two cylinder chambers arranged one behind the other, first and second pistons arranged in respective ones of said cylinder chambers, a first piston rod connected to said first piston and pivoted to said second arm of said bell-crank lever, and a second piston rod connected to said second piston and pivoted to said machine housing.

6. A forging machine as set forth in claim 1, in which each of said tools has two working profiles, each of said guides is provided with two end stops arranged to engage said baseplate in respective ones of said working positions, and said locking means for each of said tools comprise a centrally disposed, transversely extending rotary wedge, which is movable to two locking positions and adapted to force in each of said locking positions said baseplate against one of said end stops.

7. A foregoing machine as set forth in claim 6, in which said locking means comprise pivoted levers adapted to act on said rotary wedges to rotate the same and hydraulic drive means for operating said pivoted levers.

8. A forging machine as set forth in claim 7, in which said hydraulic drive means for each of said rotary wedges comprise two cylinders, two pistons, each of which is disposed in one of said cylinders, and a common piston rod rigidly connecting said pistons, one of said cylinders has an end remote from said piston rod and at said end is pivoted to said machine housing, and the other of said cylinders is longitudinally guided on said machine housing and carries a recessed coupling member for driving said pivoted lever.

9. A forging machine as set forth in claim 6, in which each of said rotary wedges has two journals rotatably mounted in said guide, each of said rotary wedges carries adjacent to each of said journals a cam, a ram is associated with each of said cams and arranged to engage the associated cam in each of said locking positions of said rotary wedge, and a spring is associated with each of said rams and stressed between the associated ram and the associated baseplate.

10. A forging machine as set forth in claim 1, in which each of said tools has more than two working profiles and said locking means for each of said tools comprise two rotary wedges, which act in mutually opposite senses of rotation.

11. A forging machine as set forth in claim 10, in which said locking means comprise pivoted levers adapted to act on said rotary wedges to rotate the same and hydraulic drive means for operating said pivoted levers.

12. A forging machine as set forth in claim 10, in which each of said rotary wedges is movable to at least one locking position, each of said rotary wedges has two journals rotatably mounted in said guide, each of said rotary wedges carries adjacent to each of said journals a cam, a ram is associated with each of said cams and arranged to engage the associated cam in each of said locking positions of said rotary wedge, and a spring is associated with each of said rams and stressed between the associated rams and the associated baseplate.

* * * * *